United States Patent [19]

Leeker et al.

[11] Patent Number: 4,911,080

[45] Date of Patent: Mar. 27, 1990

[54] SHORT-RANGE PRACTICE PROJECTILE

[75] Inventors: Jürgen Leeker, Neuss; Rudolf Rombach, Mönchen-Gladbach, both of Fed. Rep. of Germany

[73] Assignee: Rheinmetall GmbH, Düsseldorf, Fed. Rep. of Germany

[21] Appl. No.: 261,517

[22] Filed: Oct. 3, 1988

[30] Foreign Application Priority Data

Nov. 3, 1987 [DE] Fed. Rep. of Germany ..... 3737232

[51] Int. Cl.[4] ..... F42B 8/00

[52] U.S. Cl. ..... 102/529; 102/489; 102/498; 102/517; 102/520

[58] Field of Search ..... 102/386, 393, 395, 400, 102/489, 498, 502, 513, 501, 517–523, 529

[56] References Cited

U.S. PATENT DOCUMENTS

| | | | |
|---|---|---|---|
| 1,152,668 | 9/1915 | Sullivan | 102/400 |
| 1,166,879 | 1/1916 | Alard | 102/400 |
| 1,276,575 | 8/1918 | Ross | 102/400 |
| 3,013,495 | 12/1961 | Stevenson et al. | 102/513 |
| 3,164,092 | 1/1965 | Reed | 102/522 |
| 4,208,968 | 6/1980 | Hubsch et al. | 102/513 |
| 4,408,538 | 10/1983 | Deffayet et al. | 102/522 |
| 4,488,490 | 12/1984 | Betts | 102/513 |
| 4,590,862 | 5/1986 | Grabarek et al. | 102/522 |

FOREIGN PATENT DOCUMENTS

| | | | |
|---|---|---|---|
| 734429 | 4/1943 | Fed. Rep. of Germany . | |
| 2739374 | 3/1979 | Fed. Rep. of Germany | 102/529 |
| 3116175 | 11/1982 | Fed. Rep. of Germany | 102/502 |
| 496879 | 11/1919 | France | 102/522 |
| 123501 | 2/1919 | United Kingdom | 102/522 |

*Primary Examiner*—Harold J. Tudor

*Attorney, Agent, or Firm*—Spencer & Frank

[57] ABSTRACT

A practice projectile has a cylindrical casing having front and rear portions; a bottom section attached to the rear portion of the cylindrical casing; a frontal nose section including at least two subcomponents which have front and rear portions. The subcomponents can assume a closed position in which the projectile has an external configuration identical to that of a live projectile having the same caliber and an open position in which the subcomponents are in a spread-apart state at a given opening angle. The rear portion of the subcomponents is pivotally connected to the front portion of the cylindrical casing. There is further provided a device for holding the subcomponents together in the closed position prior to firing the projectile. The holding device is arranged to be overcome by centrifugal forces derived from a projectile spin subsequent to firing, to thereafter allow the subcomponents to assume the open position.

16 Claims, 2 Drawing Sheets

SHORT-RANGE PRACTICE PROJECTILE

BACKGROUND OF THE INVENTION

1. Field of the Invention

The present invention relates to a projectile for practice ammunition that has a shorter range or flight path than comparably sized combat ammunition. The projectile is of the type that has a body composed of a plurality of parts, some of which are held by a holding device before firing. The holding device is released during the flight of the projectile.

2. Discussion of the Prior Art

A projectile of the above-outlined type is disclosed by German Patent No. 734,429, according to which the projectile becomes unstable during flight because the center of gravity of the projectile is suddenly changed by the ejection or displacement of various parts of the projectile. The projectile body is composed of a plurality of components, such as segments, metal sheets and discs which are held together by means of spring-tensioned pins or balls serving as holding devices. The individual parts of the projectile separate only after a certain flight path has been traversed. Such a separation occurs once the air resistance has decreased, permitting a safety on the holding device to be released by centrifugal force or by spring. The structure of this type of projectile is very complicated and expensive. The individual flying parts of this type of projectile are unstable and unpredictable and thus constipate a danger to the environment since they can cause injury or damage.

SUMMARY OF THE INVENTION

It is therefore an object of the present invention to provide a significantly simpler projectile for practice ammunition which can be fired from artillery weapons with the same charges and in the same elevation range as live combat ammunition, even on short firing ranges.

It is a further object of the invention to ensure that, following a temporary unstable transition phase which occurs after the spin stabilized state, the projectile attains a resistance stabilized, predictable state.

In one embodiment of the invention, the projectile is to be used purely as a training projectile. In this case, the projectile traverses a very short flight path; the weapon itself and the firing process are tested without any requirements for hit accuracy on a target. In another embodiment, the projectile is equipped with a subprojectile which is disposed in the projectile and which is launched from the flying projectile. The subprojectile is then to hit a short-range target. This embodiment allows the hit accuracy requirements to be simulated.

This object and others to become apparent as the specification progresses, are accomplished by the invention, according to which, briefly stated, the practice projectile has a cylindrical casing having front and rear portions; a bottom section attached to the rear portion of the cylindrical casing; a frontal nose section including at least two subcomponents which have front and rear portions. The subcomponents can assume a closed position in which the projectile has an external configuration identical to that of a live projectile having the same caliber and an open position in which the subcomponents are in a spread-apart state at a given opening angle. The rear portion of the subcomponents is pivotally connected to the front portion of the cylindrical casing. There is further provided a device for holding the subcomponents together in the closed position prior to firing the projectile. The holding device is arranged to be overcome by centrifugal forces derived from a projectile spin subsequent to firing, to thereafter allow the subcomponents to assume the open position.

DESCRIPTION OF THE PREFERRED EMBODIMENTS

Figure 1A:
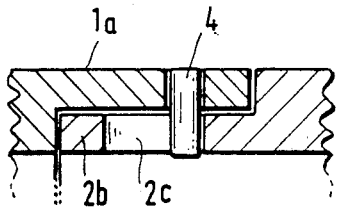
FIG. 1*a* is a detailed sectional top plan view on an enlarged scale of inset A of FIG. 1.
Figure 1:
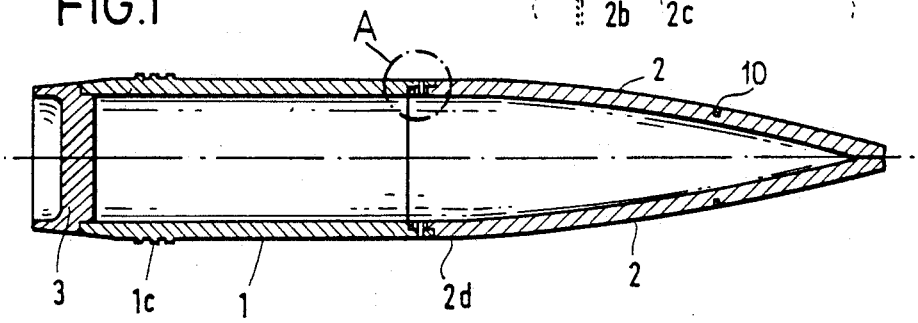
FIG. 1 is a sectional top plan view of a projectile according o a preferred embodiment of the present invention, illustrated in the closed state.
Figure 2:
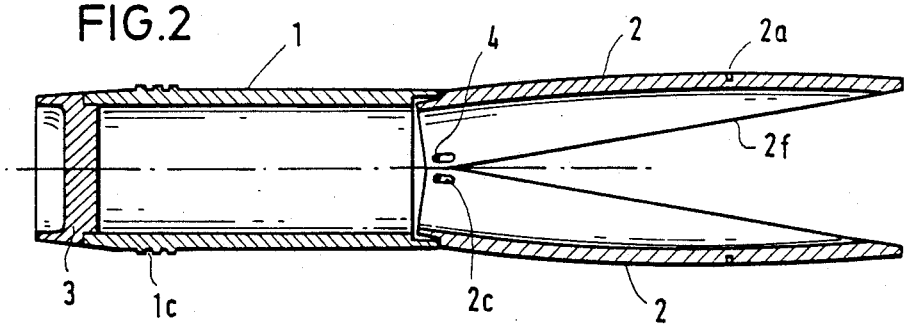
FIG. 2 is a sectional side elevational view of the projectile of FIG. 1, illustrated in the open state.
Figure 3:
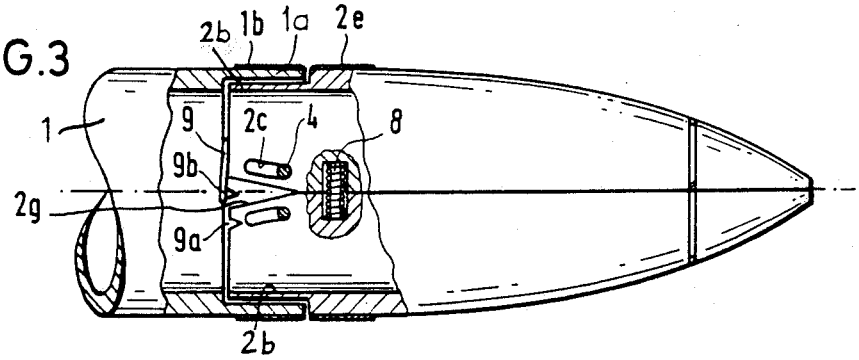
FIG. 3 is a partially sectional side elevational view on an enlarged scale showing the frontal region of the projectile according to FIG. 1, and illustrating the closed state.

The projectile shown in FIGS. 1 to 3 includes a casing 1 having a projectile bottom 3 attached at the rear end thereof. The projectile further has a frontal nose portion which is secured to the front end of the casing 1 and which is formed of at least two identical subcomponents 2. The rear of the casing 1 is provided with a guide ring 1*c* and may have a guide band 1*b* at its front. The subcomponents 2 are equipped with a groove 2*a* in their front portions to accommodate a holding ring 10 for holding the subcomponents 2 in a closed position. The front portion of the cylindrical casing 1 and the rear portion of the subcomponents 2 each include overlapping portions 1*a*, 2*b* which contain a connection means, such as a pin and slot connection. Thus, the subcomponents 2 are provided with slots 2*c* in their stepped portion 2*b* and the casing 1 is provided with pins 4 attached to its stepped portion 1*a*. Each subcomponent 2 has a first portion generally shaped as a cone which has been cut by a plane through its longitudinal axis and a second portion 2*d* generally formed as a cylinder that has been cut by a plan through its longitudinal axis. The second portion 2*d* includes a guide band Because of the spin imparted to the projectile upon firing, immediately after leaving the gun barrel, centrifugal force causes the ring 10 in the groove 2*a* to break and the subcomponents 2 to pivotally open. When the subcomponents 2 move to the open position, they pivot on the pins 4 and slide in the slots 2*c* at the same time until they reach the open position. As long as the projectile is still disposed in the gun barrel, the subcomponents cannot open because of the cylindrical portion 2*d*, the guide beads 2*e* as well as the ring disposed in the groove 2*a*. After the subcomponents have moved from the original closed position to an open position shown in FIG. 2, the projectile becomes unstable.

Since the resultant of the overall air pressure distribution now attacks the projectile at a point ahead of its center of gravity and since he subcomponents 2 are now in the open position which causes the spin to be reduced considerably, the projectile turns 180° end-over-end. In this position, with the bottom section 3 now leading and the subcomponents 2 acting as fins, the projectile flies like a fin-stabilized projectile.

The facing surfaces 2*f* of the subcomponents 2 have outwardly sloped rear face portions 2*g* which lie against one another when the subcomponents 2 are in the open position. The angle formed between the sloped surfaces 2*g* can be varied to define the angle between the subcomponents 2 in the open position.

The subcomponents 2 may be held in the open position by various means as shown in FIG. 3. One example is by using a compression spring 8 which is disposed in matching recesses in each subcomponent 2. Another example of keeping the subcomponents 2 in the open position is by using a bar 9 which has one end connected to the rear portion of one of the subcomponents and the other end containing a projection 9*b* which can engage in a corresponding opening 9*a* in the rear portion of the other subcomponent 2.

As noted earlier, after the opening of the subcomponents 2 the projectile turns around in flight and presents the flat bottom face 3 as the leading end. Due to the high air resistance caused by the leading face 3 and by the open position of the subcomponents 2, the projectile is decelerated considerably.

The range or flight path length of the projectile body can be determined by the opening angle of the subcomponents 20 which results from the respective length of the slots 2*c* and the angle of the sloped surfaces 2*g*. The angle between the subcomponents 2 in the open position must be such that the projectile can fly the remaining part of its flight path stably and for a predetermined distance without the danger of parts of the projectile coming apart.

The predetermined opening angle of the subcomponents 2 is maintained by the spring 8 or the bar 9 even when the centrifugal force decreases, whereby a predictable trajectory is obtained.

Figure 4:
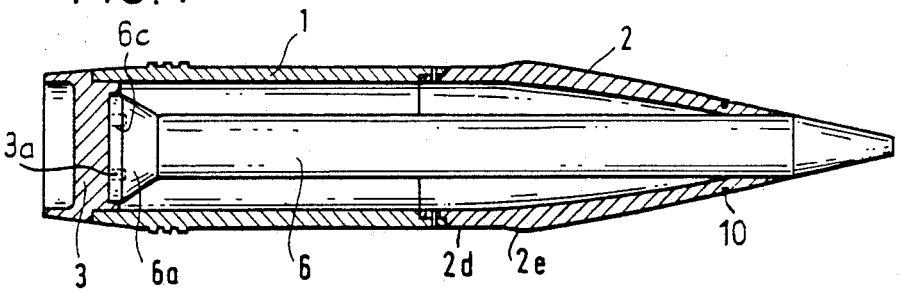
FIG. 4 is a sectional top plan view of another preferred embodiment according to the invention, illustrated in the closed state.
Figure 5:
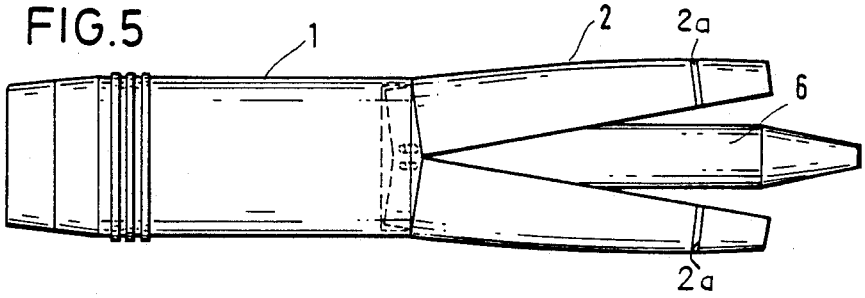
FIG. 5 is a side elevational view of the projectile of FIG. 4, illustrated in the open state.
Figure 6:
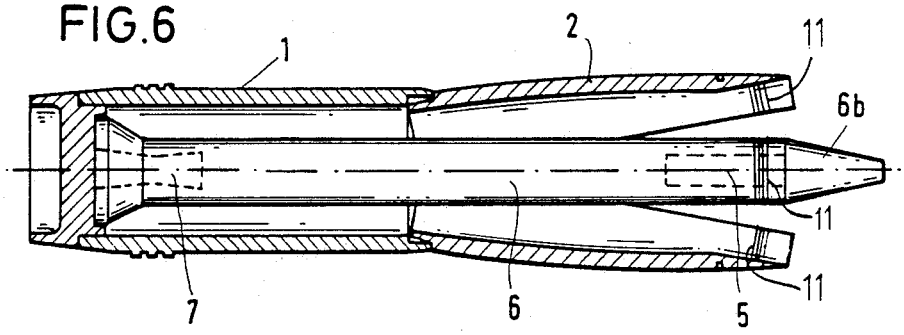
FIG. 6 is a sectional side elevational view of the construction shown in FIG. 5.

FIGS. 4 to 6 illustrate another embodiment of the present invention wherein a subprojectile 6 is coaxially disposed in the projectile body. The subprojectile 6 includes a conical guide mechanism 6*a* at one end thereof which guides the subprojectile 6 during its flight. The frontal portion of the subprojectile 6, just rearwardly of its nose portion 6*b*, is circumferentially embraced by the subcomponents 2 which, as in the previously described embodiment, are held together by a ring 10 received in a groove 2*a*.

In FIG. 4, reference numeral 2*d* identifies the section of subcomponents 2 which has a generally cylindrical shape. Reference numeral 2*e* identifies an outwardly projecting section of the subcomponents 2 which is preferably the exact caliber of the weapon while the cylindrical section 2*d* adjacent thereto is fractions of a millimeter smaller than the caliber of the weapon.

To provide for an axial immobilization of the subprojectile 6 in the projectile body, the subprojectile 6 and the subcomponents 2 are provided with intermeshing grooves and ribs or helical threads 11 as shown in FIG. 6.

The nose section 6*b* of the subprojectile 6 may contain a detonator means and an indicator charge 5 may be arranged rearwardly thereof. The tail section of the subprojectile 6 may include a tracer 7.

The embodiment according to FIGS. 4, 5 and 6 operates as follows:

As the subcomponents 2 open upon firing, the subprojectile 6 is exposed and freed from axial immobilization, as shown in FIGS. 5 and 6. The air resistance due to the open subcomponents 2 strongly brakes the projectile, whereupon the subprojectile 6 is ejected from the open projectile and flies as a guide-stabilized projectile to the target with a calculatable shortened range. The tracer 7 produces a tracer streak which allows a visual indication of where the subprojectile has flown. The indicator charge 5 then indicates the location of impact of the subprojectile 6.

The ejection of subprojectile 6 from the carrier projectile 1 occurs automatically without remote control or propellant charge. The ejection is effected solely by virtue of the different air resistance of the different crosssectional areas of the subcomponents 2 and the subprojectile 6.

For ensuring an improved spin transfer from the projectile body 1 to the subprojectile 6, these two components are coupled to one another by a torque-transmitting arrangement (form-locking means) such as small notches 6*c* provided on the rear area of the subprojectile 6 and small cams (lugs) 3*a* provided on the front area of the bottom 3 of the projectile body 1. The torque-transmitting arrangements readily separates on ejection of the subprojectile 6. present invention is susceptible to various modifications, It will be understood that the above description of the present invention is susceptible to various modifications, changes and adaptations, and the same are intended to be comprehended within the meaning and range of equivalence of the appended claims.

What is claimed is:

1. A projectile for practice ammunition having a shorter range than comparably sized combat ammunition, comprising:

a cylindrical casing having front and rear portions; said front portion including a stepped portion;

a bottom section attached to the rear portion of said cylindrical casing;

a frontal nose section including at least two subcomponents, said subcomponents having front and rear portions; the rear portion of said subcomponents including a stepped portion; said subcomponents having an open position and a closed position; in said open position the subcomponents being in a spread-apart state at a given opening angle;

said stepped portion of said cylindrical casing overlapping said stepped portion of said subcomponents;

a connection means for pivotally connecting the rear portion of said subcomponents to the front portion of said cylindrical casing; said connection means including:

pins connected to the stepped portion of said cylindrical casing; and slots of predetermined length disposed in the stepped portion of said subcomponents, wherein each of said pins extends into a respective slot on said subcomponents; and means for holding said subcomponents together in the closed position prior to firing said projectile; said means for holding said subcomponents together is arranged to be overcome by centrifugal forces derived from a projectile spin subsequent to firing.

2. A projectile as defined in claim 1, wherein said means for holding said subcomponents together includes a groove formed in said subcomponents and a ring disposed in said groove.

3. A projectile as defined in claim 1, wherein the rear portion of said subcomponents is cylindrical and has, in said closed position, the same caliber as said cylindrical casing.

4. A projectile as defined in claim 1, wherein said subcomponents include cooperating sloped surfaces in the rear portion thereof; said sloped surfaces being in an abutting, face-to-face engagement in said open position, thereby determining the magnitude of said opening angle.

5. A projectile as defined in claim 1, further comprising means for holding said subcomponents in the open position.

6. A projectile as defined in claim 5 wherein said means for holding said subcomponents in the open position is disposed between said subcomponents.

7. A projectile as define in claim 6, wherein said means for holding said subcomponents in the open position comprises a compression spring.

8. A projectile as defined in claim 5, wherein said means for holding said subcomponents in the open position is disposed between said subcomponents and said cylindrical casing.

9. A projectile as defined in claim 8, wherein said means for holding said subcomponents in the open position comprises a recess disposed in the rear portion of one of said subcomponents and a bar connected to another one of said subcomponents, said bar including a projection at one end thereof such that said projection can engage in said recess whereby said subcomponents can be held in the open position.

10. A projectile as defined in claim 1, further comprising:

a subprojectile coaxially disposed in said projectile and mounted on said bottom section, said subprojectile including a guide means for stabilizing said subprojectile once it has been launched from said projectile, wherein the front portion of said subcomponents is disposed adjacent one end of said subprojectile and said means for holding said subcomponents together is disposed in the front portion of said subcomponents.

11. A projectile as defined in claim 10, wherein said subprojectile includes a rear portion and said guide means includes a conically shaped surface disposed at the rear portion of said subprojectile.

12. A projectile as defined in claim 10, wherein said subprojectile includes a nose portion, a detonator means disposed therein and an indicator charge adjacent said detonator means.

13. A projectile as defined in claim 10, wherein said subprojectile includes a tail section and a tracer means disposed in said tail section.

14. A projectile as defined in claim 10, further comprising securing means for axially immobilizing said sub-projectile in said projectile prior to firing.

15. A projectile as defined in claim 14, wherein said securing means includes intermeshing threads disposed on the front portion of said subcomponents and on said subprojectile.

16. A projectile as defined in claim 14, wherein said securing means includes intermeshing grooves and projections on the front portion of said subcomponents and on said subprojectile.

* * * * *